US007540104B2

(12) United States Patent
Mullenbach

(10) Patent No.: US 7,540,104 B2
(45) Date of Patent: Jun. 2, 2009

(54) IRONING BOARD MOUNTED ON A WASHING MACHINE WITH MAGNETS

(76) Inventor: Alan Mullenbach, 420 Kensington Dr., Oswego, IL (US) 60543

( * ) Notice: Subject to any disclaimer, the term of this patent is extended or adjusted under 35 U.S.C. 154(b) by 0 days.

(21) Appl. No.: 12/052,963

(22) Filed: Mar. 21, 2008

(65) Prior Publication Data

US 2008/0229630 A1 Sep. 25, 2008

Related U.S. Application Data

(60) Provisional application No. 60/944,603, filed on Jun. 18, 2007, provisional application No. 60/896,331, filed on Mar. 22, 2007.

(51) Int. Cl.
*D06F 81/02* (2006.01)
*D06F 81/06* (2006.01)

(52) U.S. Cl. ..... 38/137; 108/42; 108/134

(58) Field of Classification Search ..... 38/103, 38/104, 108, 112, 137, 138, 139, 141; D32/66; 108/42, 47, 48, 134
See application file for complete search history.

(56) References Cited

U.S. PATENT DOCUMENTS 3,022,589 A * 2/1962 Kleinman ..... 38/104
D291,613 S * 8/1987 Forbes ..... D32/66
4,862,611 A * 9/1989 Wright ..... 38/103
4,862,811 A * 9/1989 Davis ..... 108/134
4,892,611 A 1/1990 Wheeler et al.
4,976,205 A 12/1990 Miller et al.
5,329,860 A 7/1994 Mattesky
5,570,642 A * 11/1996 Lehrman ..... 108/47
5,778,573 A 7/1998 Nottingham et al.
6,026,601 A * 2/2000 Kiel ..... 38/137
7,299,573 B1 * 11/2007 Kuncken ..... 38/140
7,310,899 B1 * 12/2007 Costa et al. ..... 38/137

* cited by examiner

*Primary Examiner*—Ismael Izaguirre
(74) *Attorney, Agent, or Firm*—McDonnell Boehnen Hulbert & Berghoff LLP

(57) ABSTRACT

A portable ironing board assembly which allows the ironing board to be mounted with magnets on a household appliance for convenient use and storage. The assembly has a portable mounting frame, an ironing board pivotally mounted on the frame for raising to a substantially horizontal position for use and for lowering to a substantially vertical position for storage, an ironing board support to help maintain the ironing board's horizontal position, and magnets affixed to the portable mounting frame for attaching the frame to a mounting surface.

18 Claims, 3 Drawing Sheets

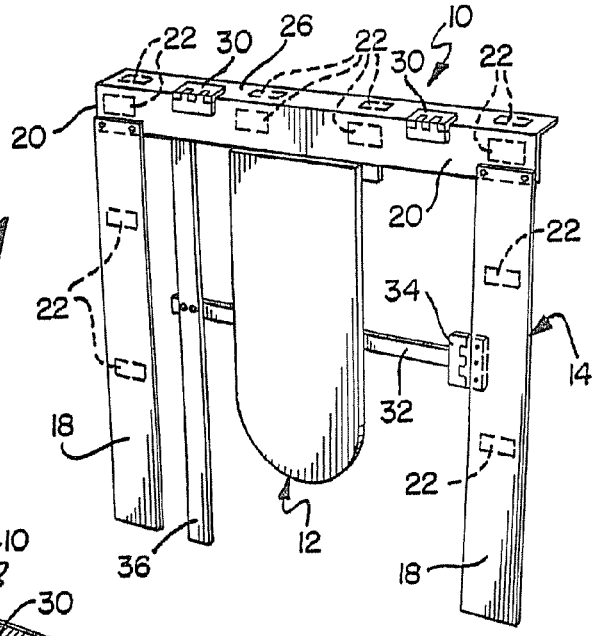
FIG. 1
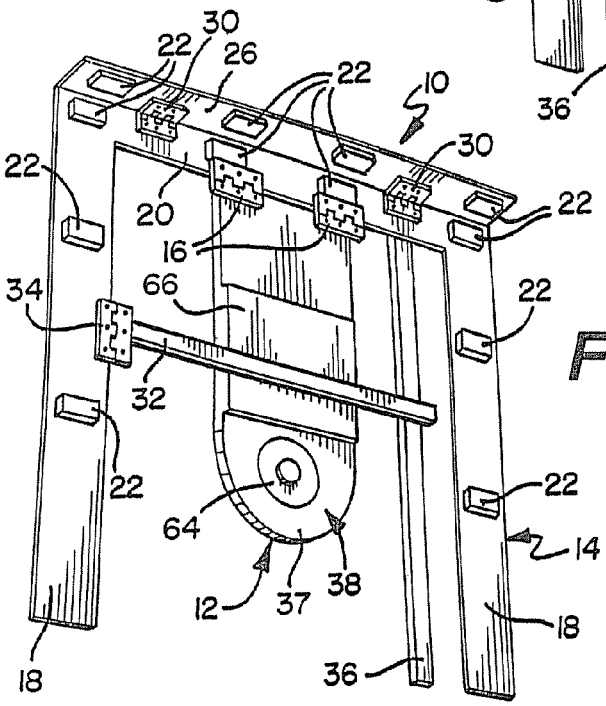
FIG. 2
FIG. 3A
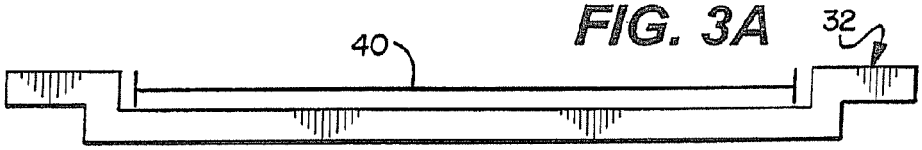
FIG. 3B
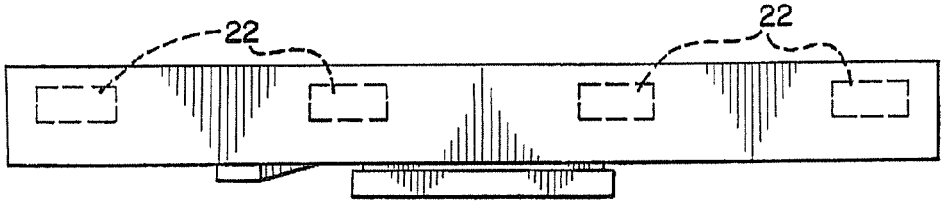

FIG. 4
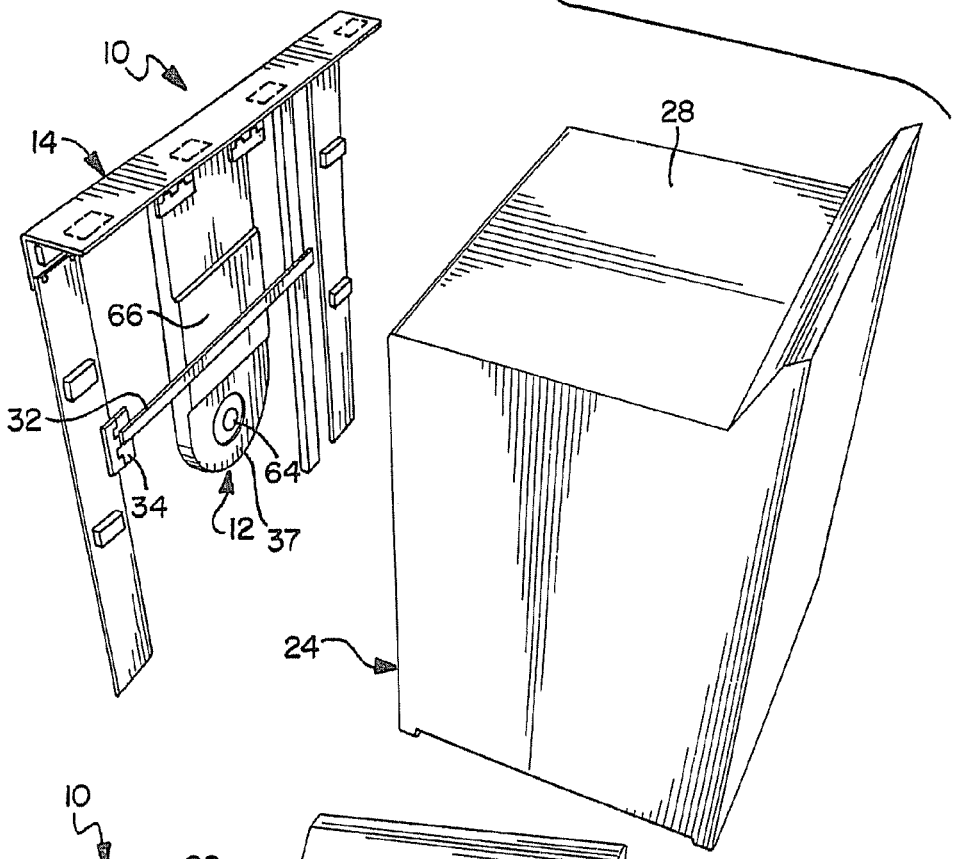
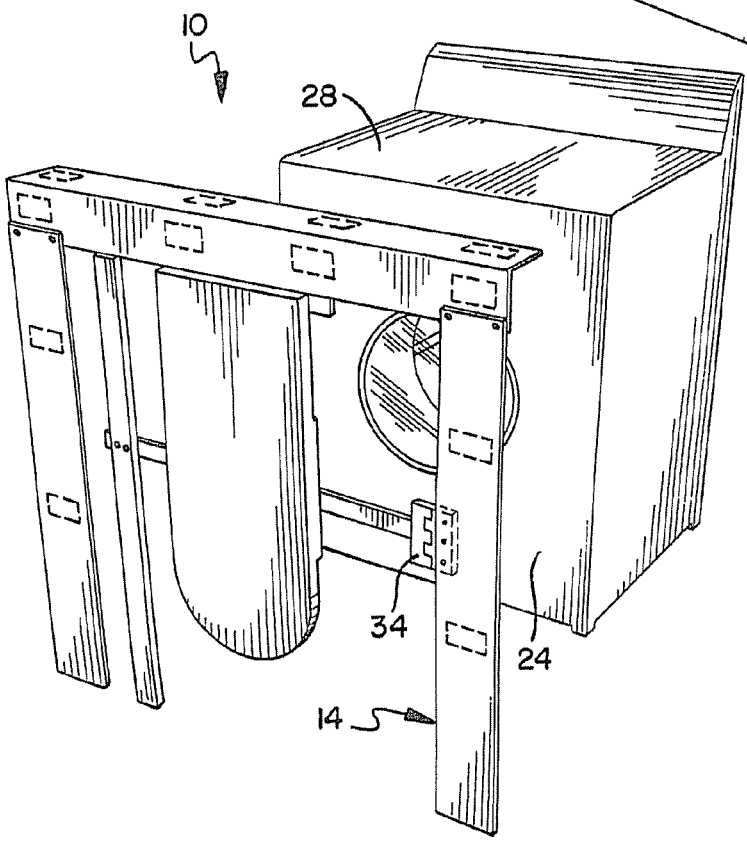
FIG. 5

IRONING BOARD MOUNTED ON A WASHING MACHINE WITH MAGNETS

FIELD OF THE INVENTION

The present invention relates to ironing boards, and more particularly, to a portable ironing board assembly that mounts on a household appliance with magnets, suction cups, Velcro™, or double sided tape and is easily stored when not in use.

BACKGROUND OF THE INVENTION

Standard type ironing boards are well known in the art. They are typically large and made of metal. This makes them heavy and hard to move, especially for the elderly or the infirm. They are typically folded or collapsed when not in use, and stored in a closet or an out of the way area. Due to their size and weight, they tend to be rather awkward to carry or move. Using such ironing boards in apartments, trailer homes, or homes of modular construction is often difficult because there is limited room to set up and use the ironing board and few places to store it To address the storage and ease of use problems, door mounted ironing board assemblies as shown in U.S. Pat. Nos. 5,329,860, 4,976,205, and 4,892,611 were made. These door mounted assemblies are associated with several disadvantages. First, the door itself may be rendered inoperable while the ironing board is in use, such that no one can easily enter or exit via the door without slamming the ironing board into an adjacent wall or hitting nearby objects causing damage to the wall and/or the nearby objects. Second, the door may be incapable of supporting the weight of the assembly, especially when coupled with the bending moment created by the user while ironing. This may lead to damage to the door or door frame, as well as the ironing board. Third, the door mounted assembly may laterally shift when the door is swung open and become dislodged. Last, the ironing board assembly is stored on the door, is readily visible to people in the room, and detracts from the general aesthetics of the room. Consequently, door mounted ironing board assemblies are not an optimal solution to the ironing board storage problem.

U.S. Pat. No. 5,778,573, attempts to alleviate these problems by mounting an ironing board on a swivel bracket in between a washer and dryer. This assembly allows the ironing board to swivel first in a vertical plane, then in a horizontal plane, finally coming to rest on top of the dryer. This swivel bracket assembly creates drawbacks of its own. First, the heavy washer and dryer may need to be moved in order to attach the swivel bracket assembly at the base of the appliance and also to create enough space to store the ironing board between the two. Second, the swivel bracket assembly may not be functional with a stackable washer and dryer, which is commonly found in the types of housing most in need of storage space. This lack of functionality with stackable washers and dryers is due to the ironing board's required planes of rotation; the horizontal rotation may be obstructed by the top stacked dryer and/or the vertical rotation may be obstructed by the closet wall or doorframe surrounding the stackable appliance. Further, where a stackable washer and dryer are both front loaded, leaving no open space between the two, there is no horizontal surface to clamp the swivel bracket to or on which to rest the ironing board.

None of these prior art devices disclose an ironing board that is affixed via magnets, suction cups, Velcro™, or double-sided tape to a home appliance, allowing the user the option to store the portable ironing board mounting assembly on the front of the appliance or easily disengage it from it's mounting surface to store in any other convenient space.

SUMMARY OF THE INVENTION

The present invention is an improved ironing board assembly which allows the ironing board to be mounted with magnets, suction cups, Velcro™, or double-sided tape on a household appliance, such as a washer or dryer, for convenient use and storage. An ironing board assembly comprises a portable mounting frame comprising a first vertical member, a second vertical member, and a front horizontal member with a first terminal end and a second terminal end. The first vertical member is attached to the first terminal end of the front horizontal member and the second vertical member is attached to the second terminal end of the front horizontal member such that the first and second vertical members are substantially parallel to each other. An ironing board is pivotally mounted on the front horizontal member of the portable mounting frame such that the pivotal mounting allows the ironing board to move from an essentially vertical position to an essentially horizontal position. An ironing board support maintains the ironing board's horizontal position. And one or more attaching components are affixed to the portable mounting frame for attaching to a first mounting surface.

In another aspect, the ironing board assembly comprises a portable mounting frame comprising a vertical member and a front horizontal member such that one end of the vertical member is essentially rigidly attached to the center of the front horizontal member to form a "T" shape. An Ironing board is pivotally mounted on the front horizontal member of the portable mounting frame such that the pivotal mounting allows the ironing board to move from an essentially vertical position to an essentially horizontal position. An ironing board support helps maintain the ironing board's horizontal position. And one or more attaching components are affixed to the portable mounting frame for attaching to a first mounting surface.

In still another aspect, the ironing board assembly comprises a portable mounting frame comprising a front member attached to a top member at a substantially ninety degree angle. An ironing board is pivotally mounted on the front member of the portable mounting frame such that the pivotal mounting allows the ironing board to move from an essentially vertical position to an essentially horizontal position. An ironing board support helps maintain the ironing board's horizontal position. And one or more attaching components are affixed to the portable mounting frame.

One object of the invention is to provide an ironing board assembly that can easily be secured to an appliance for storage and when needed, moved into a useable, essentially horizontal position without any heavy or awkward lifting. The portable mounting frame is simply placed into contact with a metallic household appliance and mounting is achieved. Then, the assembly is ready for use when the ironing board is pivoted into a horizontal position and held there by the ironing board support.

Another object of the invention is to provide an ironing board assembly that can be stored without destroying the aesthetics of a room. If the ironing board assembly is mounted on a washer and/or dryer contained in a laundry room or a closet, then the user may choose to store the assembly on the appliance. However, the user may wish to store the ironing board assembly out of sight. Employing one or more attaching components to mount the assembly allows it to be easily detached by the user and placed on a different side of the appliance, on another appliance altogether, or in a convenient storage space. Further, if a non-full sized ironing board is used, the ironing board assembly is easier to move and store.

A further object of the invention is to provide a portable ironing board that does not damage the surface on which it is mounted. Employing one or more magnets, suction cups, Velcro™, or double-sided tape to attach the ironing board assembly to a household appliance achieves this goal.

BRIEF DESCRIPTION OF THE DRAWINGS

The accompanying drawings incorporated in the specification, illustrate several aspects of the invention, and together with the description serve to explain the principles of the invention.

FIG. 1 is a perspective view from the front of the ironing board assembly in the stowed vertical position;

FIG. 2 is a perspective view from the rear of the ironing board assembly in the stowed vertical position;

FIG. 3A is a top view of the support arm containing a depression in an alternate embodiment;

FIG. 3B is a top view of the ironing board assembly;

FIG. 4 is a perspective view from the rear of the ironing board assembly and household appliance prior to mounting; and FIG. 5 is a perspective view from the front showing the ironing board assembly and household appliance prior to mounting.

DETAILED DESCRIPTION OF THE PREFERRED EMBODIMENT

Figure 6A:
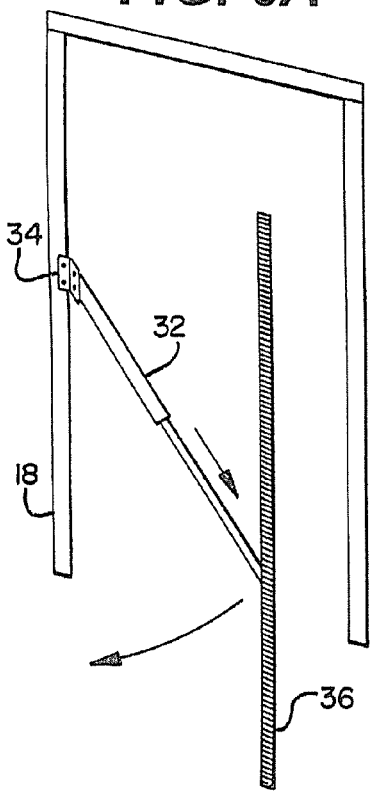
FIG. 6A is a perspective view from the front showing an alternative embodiment wherein the ironing board support comprises an adjustable unit.

Referring to FIGS. 1, 2, 4, and 5, an ironing board assembly 10 employs a conventional ironing board 12. The total length of the ironing board 12 is limited only by the standard height of the appliances on which the ironing board assembly 10 may be mounted. The ironing board's base 38 may be planar or, alternatively, a spacer 66 may be attached to the base 38 to help maintain the ironing board flush against the appliance by accounting for the dimensions of other components in the ironing board assembly 10. Also, the ironing board 38 and spacer 66 may be unitary (as shown) or separate components attached to each other with, for example, screws, rivets, or adhesives.

The ironing board 12 is pivotally attached to a portable mounting frame 14 using pivots 16 (see FIG. 2) capable of rotating about an axis, e.g. hinges or pins. The pivots 16 allow the ironing board 12 to be raised to a substantially horizontal position for use and then lowered to a substantially vertical position for storage. In the embodiment shown in FIGS. 1, 2, 3B, 4, 5, 6A, and 6B, the portable mounting frame 14 comprises two vertical members 18 attached at their distal ends to each end of a front horizontal member 20 such that the vertical members 18 are substantially parallel to each other and the frame 14 is in an upside down "U" shape. One of ordinary skill in the art will understand there are a number of ways to attach the vertical members 18 to the horizontal member 20. Without limiting the scope of the invention, the following examples illustrate potential attachment configurations: (1) the vertical members 18 may be attached, for example, by screws or rivets to the front or back of the horizontal member 20, (2) the vertical members 18 may be connected to the horizontal member 20 via a splice joint and, for example, screws or rivets, (3) the vertical members 18 may not overlap and instead be attached to the horizontal member 20 via brackets or solder, (4) the vertical members 18 may be manufactured with a snap-fit configuration to interlock with a complementary snap-fit on the horizontal member 20, or (5) the vertical members 18 and the front horizontal member 20 may be molded in a unitary structure. The length of the vertical and horizontal members 18, 20 is only limited by the height and width of the appliances on which the ironing board assembly may be mounted. In order to save on materials and overall size of the assembly, the vertical and horizontal members 18, 20 may be much shorter in dimension relative to the appliance's height and width without sacrificing stability. All portable mounting frame members 18, 20 may be made of aluminum, plastic, combinations thereof, or other lightweight, essentially rigid materials known in the art.

Affixed to the portable mounting frame are one or more attaching components 22 that attach the portable mounting frame 14 to a vertical mounting surface 24. In one aspect of the invention the attaching components are one or more magnets that are affixed to the portable mounting frame 14 to attach the portable mounting frame 14 to a vertical mounting surface 24 on an appliance, shown in FIGS. 4-5. These magnets may be encapsulated in, embedded in, or protrude from the portable mounting frame 14. The mounting frame material itself may also be magnetized. The magnets may range in size, shape, and configuration. For example, the magnets may have the same height and width dimensions as the portable mounting frame members 18, 20, such that the entire surface area of the portable mounting frame 14 in contact with the appliance is magnetized. The magnets may also be much smaller and spaced at even intervals from one another along the portable mounting frame 14, or the magnets could be clustered together where the vertical members 18 meet the horizontal member 20 and at the base of the vertical members 18. It can be appreciated by one of skill in the art that there are many configurations of magnets that will enable the successful mounting of the ironing board assembly 10 to the surface 24. In order to keep the ironing board assembly 10 portable, the magnets affixed to the portable mounting frame 14 are strong enough to maintain contact with the appliance when the ironing board 12 is in use, but weak enough that the user can detach the ironing board 12 and store it elsewhere.

In another aspect of the invention, the attaching components 22 are one or more suction cups which may be affixed to the portable mounting frame 14 and used in place of the magnets to attach the portable mounting frame 14 to a vertical mounting surface 24 on an appliance. These suction cups may be partially embedded in or protrude completely from the portable mounting frame 14. The suction cups may range in size and configuration. For example, the suction cups may have a diameter that is the same as the height of the horizontal member 20 and/or width of the vertical members 18 and line the perimeter of the portable mounting frame 14, such that the suction cups are hidden from sight when the ironing board assembly 10 is viewed from the front. The suction cups may also have a smaller diameter than the height of the horizontal member 20 and/or width of the vertical members 18 and be spaced at even intervals from one another along the portable mounting frame 14, or the suction cups could be clustered together where the vertical members 18 meet the horizontal member 20 and at the base of the vertical members 18. It can be appreciated by one of skill in the art that there are many configurations of suction cups that will enable the successful mounting of the ironing board assembly 10 to the surface 24. In order to keep the ironing board assembly 10 portable, the vacuum created between each suction cup and the vertical mounting surface 24 is strong enough to maintain contact with the appliance when the ironing board 12 is in use, but weak enough that the user can detach the ironing board 12 and store it elsewhere.

Yet another aspect of the invention employs Velcro™ as the attaching component 22 to affix the portable mounting frame 14 to a vertical mounting surface 24 on an appliance wherein the Velcro™ consists of a first side affixed to the portable mounting frame 14 and a second side affixed to the appliance. The first side of the Velcro™ may be partially embedded in or protrude completely from the portable mounting frame 14. The Velcro™ may range in size, shape, and configuration. For example, the Velcro™ may have the same height and width dimensions as the portable mounting frame members 18, 20, such that the entire surface area of the portable mounting frame 14 is in contact with the appliance via Velcro™. The Velcro™ may also be much smaller in dimension and spaced at even intervals along the portable mounting frame 14, or pieces of the Velcro™ could be clustered together where the vertical members 18 meet the horizontal member 20 and at the base of the vertical members 18. It can be appreciated by one of skill in the art that there are many configurations of Velcro™ that will enable the successful mounting of the ironing board assembly 10 to the surface 24. In order to keep the ironing board assembly 10 portable, the type of Velcro™ affixed to the portable mounting frame 14 is strong enough to maintain contact with the appliance when the ironing board 12 is in use, but weak enough that the user can detach the ironing board 12 and store it elsewhere. Prior to the first mounting of the portable ironing board assembly 10 to the appliance, only the first side of the Velcro™ will be affixed to the portable mounting frame 14. The second side of the Velcro™ will be mated to the first side such that the backing of the second side can be peeled off or removed to reveal an adhesive surface. The portable mounting frame is then aligned with and placed in contact with the appliance, pressure is applied to the portable mounting frame 14, and the adhesive backing of the second side of the Velcro™ is affixed to the appliance in perfect alignment with the Velcro™ on the portable mounting frame 14. The portable mounting frame 14 may then be removed for storage or any other purpose and the second side of the Velcro™ will remain on the appliance for future mounting of the portable ironing board assembly 10.

A further aspect of the invention employs double-sided tape as the attaching component 22 to attach the portable mounting frame 14 to a vertical mounting surface 24 on an appliance. The double-sided tape may be partially embedded in or protrude completely from the portable mounting frame 14. The double-sided tape may range in size, shape, and configuration. For example, the double-sided tape may have the same height and width dimensions as the portable mounting frame members 18, 20, such that the entire surface area of the portable mounting frame 14 is in contact with the appliance via the double-sided tape. The double-sided tape may also be much smaller in dimension and spaced at even intervals along the portable mounting frame 14, or pieces of the double-sided tape could be clustered together where the vertical members 18 meet the horizontal member 20 and at the base of the vertical members 18. It can be appreciated by one of skill in the art that there are many configurations of double-sided tape that will enable the successful mounting of the ironing board assembly 10 to the surface 24. In this embodiment, the ironing board assembly 10 is semi-permanently affixed to the appliance, such that once the ironing board assembly is removed the double-sided tape may need to be replaced in order to be remounted.

Additionally, a top horizontal member 26 that has substantially the same thickness and width of the vertical 18 and front horizontal 20 members may be rigidly connected to the front horizontal member 20 with, for example, brackets and rivets or screws on the front or back of the portable mounting frame 14 (not shown). Alternatively, the top horizontal member 26 and front horizontal member 20 may be, for example, molded or soldered together to form a unitary structure. In another embodiment, the top horizontal member 26 and front horizontal member 20 may be unitary. The top horizontal member 26 may have one or more attaching components 22 attached thereto. This helps secure the portable mounting frame 14 to a second mounting surface 28 that is adjacent to the vertical mounting surface 24 (FIGS. 4-5). In another embodiment, the top horizontal member 26 may instead be pivotally mounted to the front horizontal member 20 of the portable mounting frame 14 with, for example, one or more hinges or pins 30 (FIG. 1) which will allow the top horizontal member 26 to be substantially vertical if the ironing board assembly 10 is mounted on a front-loaded, stackable washer and dryer that does not have a horizontal second mounting surface 28.

When the ironing board 12 is extended for use, the ironing board support helps to maintain the ironing board's 12 horizontal position. In one embodiment in FIG. 2, the ironing board support comprises a support arm 32 pivotally mounted on either of the vertical members 18 using pivots 34 capable of rotating about an axis, such as hinges or pins, and a support leg 36 is essentially rigidly attached to the support arm 32 such that the support leg 36 is substantially parallel to the vertical members 18. The support arm 32 and the support leg 36 pivot away from the appliance and about the vertical member 18 to support the distal end 37 of the ironing board 12 when it is in the horizontal position. The support arm 32 may also be shorter such that the support leg 36 pivots to a point on the ironing board's base 38 closer in proximity to the appliance than to the distal end of the ironing board 12. The support arm 32 and support leg 36 may be made of aluminum, plastic, or any other preferably lightweight, essentially rigid material known in the art.

In one embodiment in FIG. 2, the support leg 36 fits into a support 64 designed to accommodate the support leg 36, such as a flange, groove or channel on the bottom of the ironing board 12. A circular support 64 is illustrated in FIG. 2. Additionally, the support leg 36 may be made wider at one or both ends, through the incorporation of a flange or a similar element. Alternatively, the support leg 36 may be a unitary structure that is wider at one or both ends. The additional width at the ends of the support leg 36 will enable the support leg 36 to more securely engage the ironing board 12 and hold it in an essentially horizontal position, enable the support leg 36 to maintain its essentially vertical position (when extended from the mounting frame 14 or not), or a combination thereof. In an alternate embodiment, the support leg 36 is capable of telescoping to adjust for variations in height among appliances.

Figure 6B:
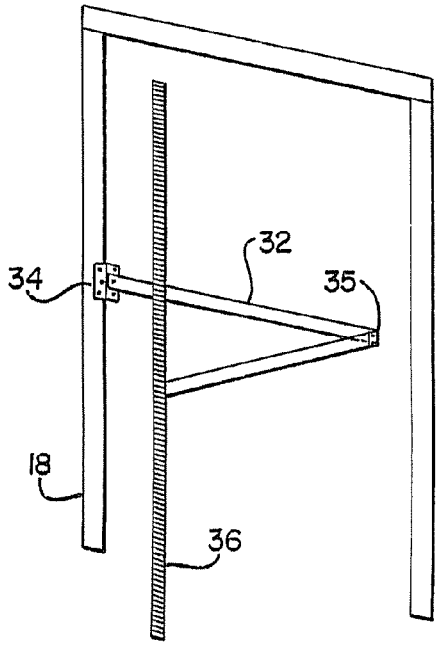
FIG. 6B is a perspective view from the front showing an alternative embodiment wherein the ironing board support comprises a foldable unit.

In another embodiment, as shown in FIG. 3A, the support arm 32 contains a depression 40 to accommodate protrusions on the vertical mounting surface 24, due to front-loaded washers and dryers for instance, that would otherwise prevent the support arm 32 from resting flush against the vertical mounting surface 24. Alternatively, the support arm 32 may be extendable. For example, as shown in FIG. 6A, the support arm 32 may comprise an adjustable unit capable of telescoping to the distal end 37 (FIGS. 7 & 8) of the ironing board 12. Or, as illustrated in FIG. 6B, the support arm 32 may comprise a foldable unit wherein the support arm 32 includes a pivot joint 35 capable of rotating about an axis, e.g. a hinge, pin, or ball-and-socket, that allows the support arm 32 to rotate on the pivot joint 35 until it is substantially parallel to or at an acute angle to itself when the ironing board 12 is in the stowed, vertical position. When the ironing board 12 is in the upright, horizontal position, support arm 32 rotates away from the appliance about vertical member 18 on pivots 34 and then unfolds on pivot joint 35 toward the distal end 37 of ironing board 12. Both embodiments in FIGS. 6A and 6B allow the "U" shaped portable mounting frame 14 to be more compact.

Figure 7:
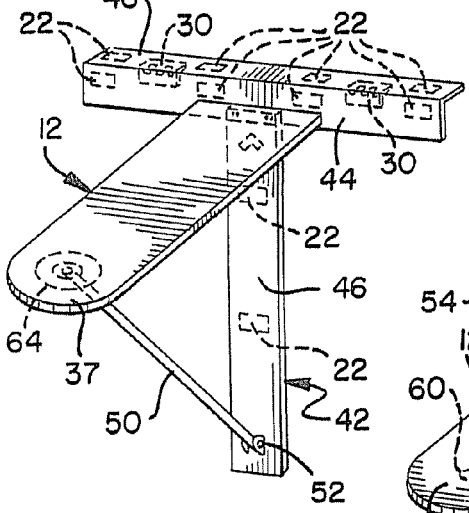
FIG. 7 is a perspective view from the front showing the ironing board assembly and household appliance in an alternative embodiment wherein the portable mounting frame is in a "T" shape.

In another embodiment shown in FIG. 7, the portable mounting frame 42 comprises a front horizontal member 44 and vertical member 46 wherein one end of the vertical member 46 is essentially rigidly attached to the center of the front horizontal member 44 to form a "T" shape. The portable mounting frame 42 may also be rigidly or pivotally attached to a top horizontal member 48 in conformance with the description above. One or more attaching components 22 are affixed to the portable mounting frame 42 to attach the portable mounting frame 42 to a vertical mounting surface 24 on an appliance. This embodiment employs an ironing board support that comprises a bracing arm 50 pivotally mounted on the base of the vertical member 46 using pivots 52 capable of rotating about an axis, e.g. hinges or pins. The bracing arm 50 pivots away from the appliance toward the distal end 37 of the ironing board 12 when it is in the horizontal position and contacts the ironing board 12 at its base 38, where a support 64, for example a flange, groove, or channel, is positioned to accommodate the bracing arm 50. The bracing arm 50 may be extendable, where it comprises an adjustable unit capable of telescoping or unfolding on a pivot joint 35 to the distal end 37 of the ironing board 12.

Alternatively, where the portable mounting frame is configured in a "T" shape, the ironing board support may comprise a bracing arm 50 pivotally mounted to the ironing board 12 using pivots 52 capable of rotating about an axis, e.g. hinges or pins. The bracing arm 50 pivots away from the ironing board 12 toward the ground when the ironing board 12 is in a substantially horizontal position. The bracing arm 50 may rotate until its distal end comes to rest in a support 64 on the vertical member 46, such as a flange, groove, or channel, designed to accommodate the bracing arm 50, or the bracing arm 50 may rotate substantially ninety degrees coming to rest on the floor and have any of the attributes of support leg 36 described above. The bracing arm 50 may also be extendable, where it comprises an adjustable unit capable of telescoping to the distal end 37 of the ironing board 12.

Figure 8:
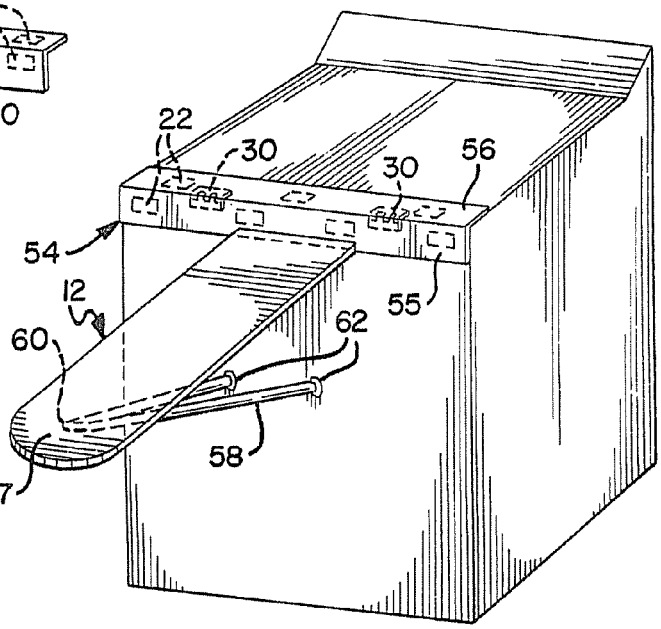
FIG. 8 is a perspective view from the front showing the ironing board assembly and household appliance in an alternative embodiment wherein the portable mounting frame comprises a front member essentially rigidly attached to a top member at a substantially ninety degree angle.

In a further embodiment shown in FIG. 8, the portable mounting frame 54 comprises a front member 55 essentially rigidly or pivotally attached to an adjacent top member 56 at a substantially ninety degree angle. The length and width of the front member 55 and top member 56 are only limited by the height and width of the appliances on which the ironing board assembly 10 may be mounted. FIG. 8 illustrates only one variation of this particular embodiment in which the front member 55 and top member 56 are essentially the same width and length. However, the length and width of the front and top members 55, 56 may vary; for example, the front member 55 may be the width of the ironing board 12 and extend from the top of the appliance to the base, while the top member 56 may be the width of the appliance and extend a reasonable distance in length to engage in contact with the horizontal mounting surface 24 of the appliance. One or more attaching components 22 are affixed to the portable mounting frame 54 to attach the frame to horizontal and vertical mounting surfaces 24, 28 on an appliance. The ironing board support comprises a stabilizing arm 58 pivotally mounted to the distal end 37 of the ironing board 12 using pivots 60 capable of rotating about an axis, e.g. hinges or pins. The stabilizing arm 58 pivots away from the ironing board 12 toward the ground when the ironing board 12 is in a substantially horizontal position. The stabilizing arm 58 may rotate substantially ninety degrees coming to rest on the floor and have any of the attributes of support leg 36 described above. Alternatively, the stabilizing arm's 58 rotation may be restricted to a predetermined, acute angle designed such that the arm's distal end comes to rest against the vertical mounting surface 24 of the appliance wherein the distal end is attached to a brace 62, for example a rubber cap or suction cup, both to protect the appliance surface 24 from the stabilizing arm 58 and to create a frictional contact to prevent slippage. In this configuration, the stabilizing arm 58 may be wider at the distal end that makes contact with the appliance surface 24 or may consist of a plurality of stabilizing arms 58 splayed to increase points of contact on the appliance to obtain increased stability. The stabilizing arms 58 may be extendable, where they comprise adjustable units capable of telescoping to the appliance surface 24 or to the ground.

The foregoing detailed description has been presented for purposes of illustration and description. It is not intended to be exhaustive or to limit the invention to the precise form disclosed. Modifications will become obvious to those skilled in the art upon reading this disclosure and may be made without departing from the spirit of the invention or the scope of the appended claims.

The invention claimed is:

1. An ironing board assembly comprising;

a portable mounting frame comprising a first vertical member, a second vertical member, and a front horizontal member having a first terminal end and a second terminal end;

wherein said first vertical member is attached to said first terminal end of said front horizontal member and said second vertical member is attached to said second terminal end of said front horizontal member such that said first and second vertical members are substantially parallel to each other;

an ironing board pivotally mounted on said front horizontal member of the portable mounting frame wherein the pivotal mounting allows the ironing board to move from an essentially vertical position to an essentially horizontal position;

an ironing board support to maintain said ironing board's horizontal position; and one or more attaching components affixed to said portable mounting frame for attaching to a first mounting surface on an appliance, wherein the one or more attaching components do not penetrate the first mounting surface.

2. The ironing board assembly of claim 1, wherein said portable mounting frame further comprises:

a top horizontal member having substantially the same thickness and width of said front horizontal member that is essentially rigidly connected to said portable mounting frame; and one or more attaching components affixed to said top horizontal member for attaching to a second mounting surface adjacent to said first mounting surface.

3. The ironing board assembly of claim 2, wherein the ironing board support comprises:

a support arm pivotally mounted on either said first vertical member or said second vertical member; and a support leg rigidly attached to said support arm such that said support leg is substantially parallel to said vertical members wherein said support arm and said support leg pivot about said vertical member to support the distal end of said ironing board when it is in the horizontal position.

4. The ironing board assembly of claim 3, wherein the support leg is adjustable to accommodate different heights of said first and second mounting surfaces.

5. The ironing board assembly of claim 4, wherein the support arm comprises:

an adjustable unit capable of extending to the distal end of said ironing board.

6. The ironing board assembly of claim 4, wherein the support arm comprises:

a foldable unit wherein said support arm includes a pivot joint that allows said support arm to rotate on said pivot joint until is substantially parallel to or at an acute angle to itself when said ironing board is in the stowed vertical position.

7. The ironing board assembly of claim 3, wherein said support arm contains a depression to accommodate protrusions on said first mounting surface

8. The ironing board assembly of claim 1, wherein said portable mounting frame further comprises:

a top horizontal member having substantially the same thickness and width of said front horizontal member that is pivotally connected to said portable mounting frame; and one or more attaching components affixed to said top horizontal member for attaching to a second mounting surface adjacent to said first mounting surface or for attaching to said first mounting surface for additional support where said second mounting surface is not present.

9. The ironing board assembly of claim 8, wherein the ironing board support comprises:

a support arm pivotally mounted on either said first vertical member or said second vertical member; and a support leg rigidly attached to said support arm such that said support leg is substantially parallel to said vertical members wherein said support arm and said support leg pivot about said vertical member to support the distal end of said ironing board when it is in the horizontal position.

10. The ironing board assembly of claim 9, wherein the support leg is adjustable to accommodate different heights of said first and second mounting surfaces.

11. The ironing board assembly of claim 10, wherein the support arm comprises:

an adjustable unit capable of extending to the distal end of said ironing board.

12. The ironing board assembly of claim 10, wherein the support arm comprises:

a foldable unit wherein said support arm includes a pivot joint that allows said support arm to rotate on said pivot joint until is substantially parallel to or at an acute angle to itself when said ironing board is in the stowed vertical position.

13. The ironing board assembly of claim 9, wherein said support arm contains a depression to accommodate protrusions on said first mounting surface.

14. The ironing board assembly of claim 1, wherein the one or more attaching components comprise magnets.

15. The ironing board assembly of claim 1, wherein the portable mounting frame comprises at least one attaching component receptacle capable of holding at least one attaching component.

16. An ironing board assembly comprising:

a portable mounting frame comprising a vertical member and a front horizontal member wherein one end of said vertical member is attached to the center of said front horizontal member to form a "T" shape;

an ironing board pivotally mounted on said front horizontal member of the portable mounting frame wherein the pivotal mounting allows the ironing board to rotate about a single axis from an essentially vertical position to an essentially horizontal position;

an ironing board support to help maintain said ironing board's horizontal position; and one or more attaching components affixed to said portable mounting frame for attaching to a first mounting surface on an appliance.

17. The ironing board assembly of claim 16, wherein said portable mounting frame further comprises:

a top horizontal member having substantially the same thickness and width of said front horizontal member that is connected to said portable mounting frame; and one or more attaching components affixed to said top horizontal member for attaching to a second mounting surface adjacent to said first mounting surface or for attaching to said first mounting surface for additional support where said second mounting surface is not present.

18. An ironing board assembly comprising:

a portable mounting frame comprising a front member attached to a top member at a substantially ninety degree angle;

an ironing board pivotally mounted on said front member of the portable mounting frame wherein the pivotal mounting allows the ironing board to rotate about a single axis from an essentially vertical position to an essentially horizontal position;

an ironing board support to help maintain said ironing board's horizontal position; and one or more attaching components affixed to said portable mounting frame for attaching to a first mounting surface on an appliance.

* * * * *